US008742275B1

(12) United States Patent
Lam et al.

(10) Patent No.: US 8,742,275 B1
(45) Date of Patent: Jun. 3, 2014

(54) CANTILEVERED INTEGRATED FUNCTION KEYS

(71) Applicant: Google Inc., Mountain View, CA (US)

(72) Inventors: Lawrence Lam, San Jose, CA (US); Kenneth Ryan Loo, San Jose, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/717,228

(22) Filed: Dec. 17, 2012

Related U.S. Application Data

(63) Continuation of application No. 13/569,828, filed on Aug. 8, 2012, now abandoned, which is a continuation of application No. 13/347,426, filed on Jan. 10, 2012, now abandoned.

(60) Provisional application No. 61/576,701, filed on Dec. 16, 2011.

(51) Int. Cl.
*H01H 1/10* (2006.01)

(52) U.S. Cl.
USPC ..... 200/516

(58) Field of Classification Search
USPC ..... 200/516, 406, 5 A, 5 R, 292, 510–515, 200/517, 344, 341, 343, 345, 296
See application file for complete search history.

(56) References Cited

U.S. PATENT DOCUMENTS

| | | | | |
|---|---|---|---|---|
| 3,627,935 | A | 12/1971 | Spievak | |
| 4,032,729 | A | 6/1977 | Koistinen | |
| 4,128,744 | A | 12/1978 | Seeger | |
| 4,160,886 | A | 7/1979 | Wright et al. | |
| 4,323,740 | A | 4/1982 | Balash | |
| 4,430,531 | A | 2/1984 | Wright | |
| 4,620,075 | A | 10/1986 | La Belle et al. | |
| 5,422,447 | A | 6/1995 | Spence | |
| 5,481,074 | A * | 1/1996 | English | 200/5 A |
| 5,914,468 | A | 6/1999 | Nishimura et al. | |
| 6,930,260 | B2 * | 8/2005 | Clegg et al. | 200/5 A |
| 6,940,030 | B2 | 9/2005 | Takeda et al. | |
| 7,005,588 | B2 | 2/2006 | Pihlaja | |
| 7,151,237 | B2 * | 12/2006 | Mahoney et al. | 200/512 |

(Continued)

OTHER PUBLICATIONS

Notice of Allowance for U.S. Appl. No. 13/347,426, mailed May 11, 2012, 16 pages.

(Continued)

*Primary Examiner* — Edwin A. Leon
(74) *Attorney, Agent, or Firm* — Brake Hughes Bellermann LLP

(57) ABSTRACT

According to one general aspect of the invention, an input device includes a collapsible structure and a sheet of material. The sheet of material is disposed above the collapsible structure and includes an attached edge that is affixed to a housing of the input device, creating a pivot point. The sheet of material also includes a front edge opposite the attached edge, a left edge, and a right edge. The sheet of material has a width extending from the left edge to the right edge and a height extending from the front edge to the pivot point. A first opening is formed proximate the front edge of the sheet of material. The collapsible structure is disposed below a portion of the sheet of material located between the front edge and a midpoint of the height of the sheet. The collapsible structure is approximately centered between the left and right edges.

25 Claims, 6 Drawing Sheets

(56) References Cited

U.S. PATENT DOCUMENTS

| | | | |
|---|---|---|---|
| 7,360,957 | B2 | 4/2008 | Dombrowski et al. |
| 7,432,460 | B2 | 10/2008 | Clegg et al. |
| 8,053,689 | B2 | 11/2011 | Kim et al. |
| 8,280,459 | B2 | 10/2012 | Wojack et al. |
| 2010/0091442 | A1 | 4/2010 | Theobald et al. |
| 2011/0062008 | A1 | 3/2011 | Cheng et al. |
| 2011/0220479 | A1 | 9/2011 | Zhou |

OTHER PUBLICATIONS

Non-Final Office Action for U.S. Appl. No. 13/347,426, mailed Apr. 27, 2012, 10 pages.
RCA Remote circa 1980s, 1 page.
Notice of Allowance for U.S. Appl. No. 13/569,828, mailed Sep. 19, 2012, 10 pages.
Non-Final Office Action for U.S. Appl. No. 12/983,688, mailed Mar. 4, 2013, 12 pages.

* cited by examiner

CANTILEVERED INTEGRATED FUNCTION KEYS

This application is a continuation of U.S. application Ser. No. 13/569,828, filed Aug. 8, 2012, which is a continuation of U.S. application Ser. No. 13/347,426, filed Jan. 10, 2012, which claims the benefit of priority to U.S. Provisional Application No. 61/576,701, filed Dec. 16, 2011, the disclosures of which are incorporated herein by reference.

TECHNICAL FIELD

This description relates to keys for an input in a computing device such as a keyboard for a computer system.

BACKGROUND

Keys of computing devices typically include switches used to provide input to a processor of the electronic devices. For example, keys are used to activate the switches of a computer keyboard. The keys typically include a symbol, such as a letter, a number, or a combination of these, which indicates the function or association of the switch that is activated by that particular key. For example, on a keyboard, when the key marked with the letter "a" is depressed, the switch associated with the "a" key is actuated. Many keyboards also include a row of functions keys, such as "F1" through "F12." Typically the function keys are located above the main keys (i.e. the QWERTY keys) of the keyboard. Often times function keys initiate predetermined processes. For example, when the keyboard is in communication with a word processor or a computer that is running word processing software, the depression of an "F5" key and the associated actuation of the "F5" switch may initiate a "Find-and-Replace" function for the document.

Some keyboards include individual keys that are supported by an underlying structure. For example, sometimes a scissor mechanism is used to support the keycap (i.e. the portion of the key visible to a user) of the key. The scissor mechanisms can include a pair or arms that are pivotally coupled to each other. The scissor mechanisms can help prevent the keycaps from rocking or tilting. The scissor mechanisms are configured to remain in an expanded configuration when the keycap is not being depressed by a user and are configured to assume a contracted configuration when the keycap is depressed by a user.

The structures that underlie keycaps offer a tactile response (i.e. a snappy feel) that gives feedback to users as they type. These structures, however, can take up space. Specifically, the underlying structures can add to the thickness of an input device, such as a keyboard. Furthermore, special keys, like the function keys, often make the keyboard appear crowded and increase the footprint of the computing device.

SUMMARY

According to one general aspect of the invention, an input device includes a collapsible structure used to complete a circuit and a sheet of material disposed above the collapsible structure. The sheet of material includes an attached edge affixed to a housing of the input device, creating a pivot point. The sheet of material also includes a front edge opposite the attached edge, a left edge, and a right edge opposite the left edge. The sheet of material has a width extending from the left edge to the right edge and a height extending from the front edge to the pivot point. The sheet also includes a first opening formed proximate the attached edge. The collapsible structure is disposed below a portion of the sheet of material located between the front edge and the midpoint of the height of the sheet and approximately centered between the left edge and the right edge.

According to another general aspect of the invention, an input device includes two or more keys. Each key comprises a collapsible switch and a spring disposed above the collapsible switch. The spring includes a back edge affixed to a housing of the input device, creating a pivot point. The spring also includes a front edge opposite the back edge, a left edge, a right edge opposite the left edge, and a height extending from the back edge to the front edge. The spring also includes a first opening formed proximate the back edge. Each spring has an associated collapsible switch. A portion of a bottom surface of the spring contacts the collapsible switch, the portion of the bottom surface being at a location between the front edge of the spring and a midpoint of the height of the spring and approximately centered between the left edge and the right edge. The springs are unitarily formed from a sheet of material, each spring being separated from adjoining springs by a gap formed in the material so that the springs are joined at the back edge.

According to another general aspect of the invention, an input device includes two or more keys. Each key of the input device includes a collapsible dome, a keycap, and a spring attached to a housing of the input device on a first end. The spring also includes a second end opposite the first end, a first opening located proximate the first end, and a second opening located proximate the second end and is configured to bend around the first end at a pivot point when a user applies pressure to a top surface of the keycap. The keycap is disposed above the second opening and a portion of a bottom surface of the keycap contacts the collapsible dome when pressure is applied to the keycap. The pressure causes the dome to collapse, sending an input to a processor of a computing device. The springs are unitarily formed from a sheet of material and each spring is separated from adjoining springs by a gap formed in the material so that the springs are joined at the first end.

The details of one or more implementations are set forth in the accompanying drawings and the description below. Other features will be apparent from the description and drawings, and from the claims.

DETAILED DESCRIPTION

Disclosed embodiments provide a key for an input device. The key is a tactile button but may be incorporated into the housing of the computing device, reducing the appearance of the footprint of the keyboard. The keycap may rest at the end of a cantilevered spring but feel like it is travelling straight up and down no matter where the user presses the key. In some embodiments the spring and keycap work with a backlight module to allow light to pass through and illuminate indicia associated with the key.

Figure 1:
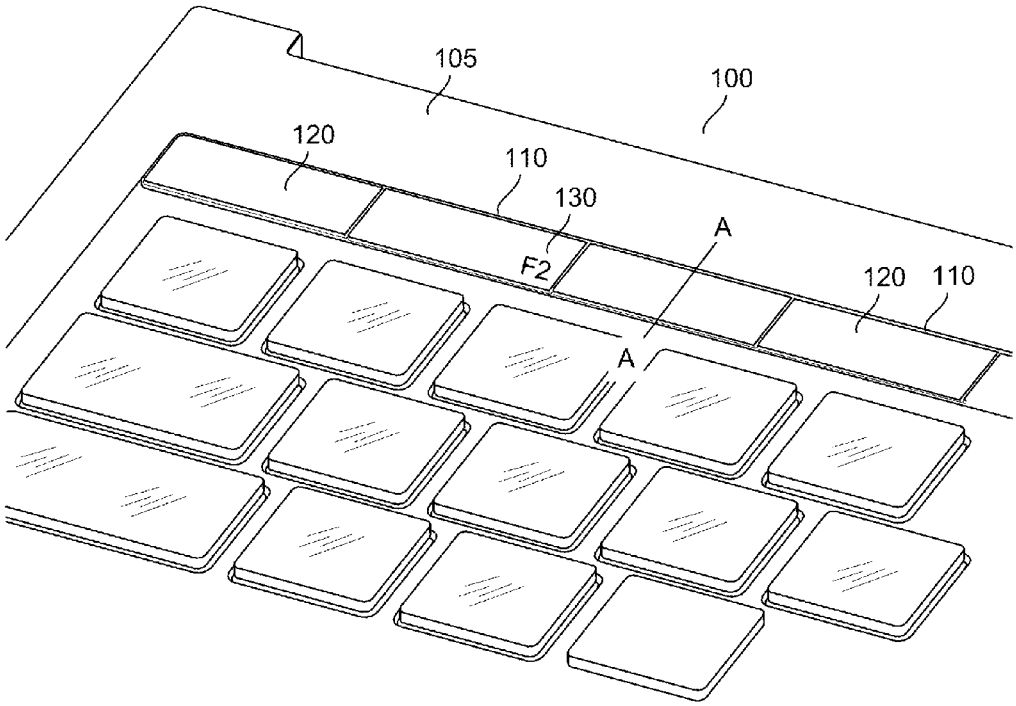
FIG. 1 is a prospective view of a portion of an example input device.

FIG. 1 is a schematic diagram of an input device 100. The input device 100 can be an input device of any type of electrical or mechanical device. For example, the input device 100 can be coupled to and can communicate with a processor of a computer system, such as a laptop, netbook, desktop, or tablet system. In the illustrated implementation, the input device 100 is a computer keyboard (a QWERTY keyboard) and includes a plurality of keys, including a row of one or more function keys 110. Function keys may be located above, below or on either side of a main set of keys, such as alphabetic or numeric keys (i.e. QWERTY keys). Although FIG. 1 depicts function keys 110 at the top of the input device 100, embodiments are not limited to such a placement.

In some implementations, keys 110 appear seamless with the housing 105 of the input device. In other words, the keys 110 may have a keycap 120 made of the same material as housing 105 and have minimal spacing between the keys. In further embodiments, the keys 110 abut housing 105. Housing 105 may include any structure that encases internal components of input device 100 not normally visible to a user of input device 100. For example, housing 105 may include the material used to cover the internal components or the fasteners (e.g. screws, posts, snaps, etc.) that hold the internal components in place.

In some implementations, function keys 110 include keycaps 120. Keycaps 120 may include an indicia 130, such as one or more alphanumeric characters, to identify the key and the switch associated with that particular key. In some implementations, the indicia 130 are painted on an upper surface of the keycaps 120. In other implementations, another material is disposed on an upper surface of the keycaps 120 to form the indicia 130. In some implementations the indicia 130 may be translucent so that the indicia 130 becomes illuminated when a light source is placed behind the key 110.

Each key 110 may comprise a spring portion 200 and a switch portion 310. In some embodiments the spring portion 200 is a cantilevered spring. A cantilevered spring is a type of spring that is fixed at one end and designed to flex, for example, like a diving board. The spring portion 200 may be configured to move from a first configuration to a second configuration. In some implementations, the spring 200 is biased into its first configuration until a force is applied to keycap 120. When a force is applied to keycap 120 the spring 200 is configured to allow the key 110 to move from the first position or configuration (an un-depressed configuration) to the second position or configuration (a depressed configuration) and to actuate the switch 310. In some implementations, the spring 200 is configured to return to its un-depressed configuration after the force is removed from the key 110 (to bias the key 110 to its un-depressed configuration).

Figure 2:
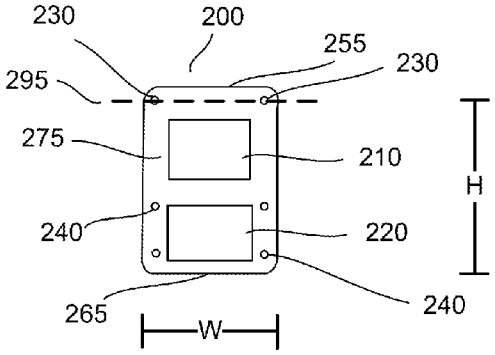
FIGS. 2-4 are top views of an exemplary spring portion of the input device of FIG. 1.
Figure 3:
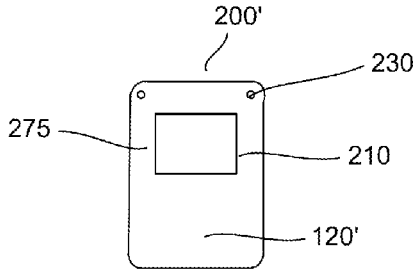
Figure 4:
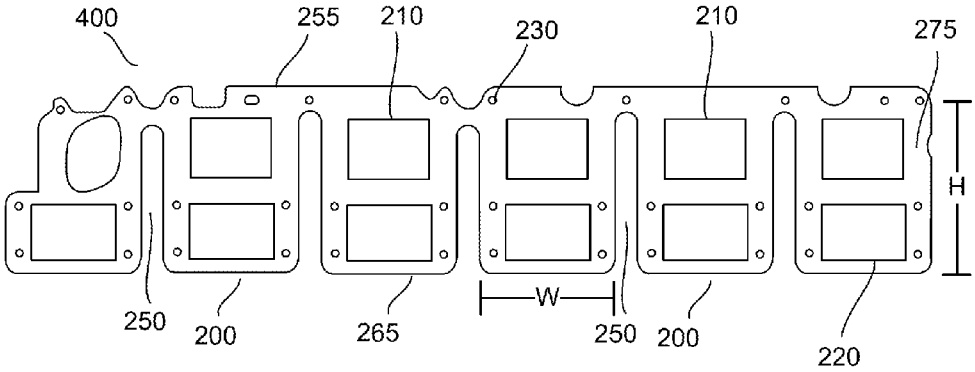

FIGS. 2-4 are top views of an exemplary spring portion 200 that comprises keys 110 of input device 100. FIG. 2 shows a spring 200 made of a sheet of material. In some embodiments the material is stainless steel, aluminum, titanium or other metal material. In other implementations, the sheet of material is formed of another flexible material such as a plastic. Spring 200 may include a first opening 210 that extends through the thickness of the sheet of material. Opening 210 may be proximate the top edge 255 of spring 200. Top edge 255 may be configured to be affixed or attached to the housing 105 of input device 100. In some implementations, spring 200 has a height ("H") and a width ("W"). In some embodiments, opening 210 may extend up to a midpoint 295 of the height of spring 200.

In some embodiments, spring 200 may be attached to the housing of input device 100 by posts 107 (shown in FIG. 6) extending through openings 230 in a cantilevered manner. In other embodiments, top edge 255 may be affixed to the housing other types of fasteners, or top edge 255 may fit into a slot of the housing and held in place by pressure in a vice-like manner. Other methods of attaching spring 200 to the housing 105 may be used. The attachment of edge 255 may allow spring 200 to bend or move about the attachment point 292 (i.e. the fulcrum or pivot point). Such movement may be similar to the motion of a diving board.

Spring 200 may be configured to move from a first configuration to a second configuration. In some implementations, the spring 200 is biased into its first configuration. For example, in some implementations spring 200 includes a portion 275 that is configured to bend or flex to allow the key 110 to move from a first position or configuration (an un-depressed configuration) to its second position or configuration (a depressed configuration) and to actuate a switch 310 (shown in FIG. 6). In such implementations portion 275 is resilient enough to cause the spring 200 to return to its first configuration after a force ("F" in FIG. 6) that caused the spring 200 to move it its second configuration is removed.

The configuration of opening 210 may affect the force needed to move spring 200 from its first configuration to its second configuration. For example, an opening 210 with a longer height with respect to the height of spring 200 may allow spring 200 to bend with less force while a smaller opening 210 (with respect to height) may make spring 200 more rigid, requiring more force to move spring 200 to its second configuration. In some embodiments opening 210 may have a height that is approximately ⅓ of the height of spring 200. In some implementations, the height of spring 200 runs from the fulcrum or pivot point 295 to bottom edge 265. The pivot point 295 is the point where spring 200 is attached to housing 105, for example at openings 230. Opening 210 may also have a width of approximately ⅗ths of the width of the spring 200, the width of the spring extending from the left edge to the right edge. In one example, if spring 200 has a height of 21.03 mm (from openings 230 to edge 265) and a width of 20 mm (from left edge to right edge), opening 210 may have a height of approximately 7.5 mm and a width of approximately 12 mm.

In some implementations the spring 200 also includes a second opening 220. Opening 220 may allow a light source located under the spring 200 to pass through spring 200. In some embodiments, this allows light to reach a keycap 120, which is located on a top surface of the spring 200. The second opening 220 may be placed in a portion of spring 220 that is designed to protrude from under the housing 105 of input device 100. In some implementations this opening occurs between the mid-point of the height of spring 200 and the bottom end 265. Opening 220 may be of any suitable size to allow light to reach keycap 120. In some implementations keycap 120 is affixed to the spring 200 using pegs that fit through openings 240. In some implementations keycap 120 may cover the portion of spring 200 that protrudes from under the housing 105, so that the spring 200 is not visible to a user.

FIG. 3 shows a sheet of material forming spring 200' that does not include opening 220. A portion of a bottom surface of spring 200' may contact switch 310. In some embodiments, spring 200' may not have a keycap 120. In such embodiments, a portion of an upper surface of spring 200' may protrude from under the housing 105 of input device 100 may be visible to a user of input device 100 and serve as keycap 120'. In other implementations a separate keycap 120 may be affixed to spring 200', for example by adhesion or openings 240 (not shown).

In some implementations, keycap 120 or 120' may include indicia formed by openings defined in the surface of the key. For example, in some implementations, keycap 120 includes defined indicia openings (openings, for example, that form alphanumeric characters). In some implementations, the openings include a plurality of openings that collectively form a single alphanumeric character of one of the keys 110. In some such implementations, the input device 100 includes a backlight, such as a set of light emitting diodes, configured to emit light through the second opening 220 and/or the plurality of indicia openings. Accordingly, the user may view the illuminated plurality of indicia openings and identify the key.

In further implementations, a plurality of springs 200 or 200' may be unitarily formed from a sheet of material, as shown in FIG. 4. Although FIG. 4 depicts a plurality of springs 200, those of ordinary skill in the art will recognize that a plurality of springs 200' or a combination of springs 200 and 200' may be formed from a single sheet. Springs 200 may be joined at edge 255 and defined by spaces 250 cut into the sheet of material. Spaces 250 may run for the majority of the height of springs 200. In some embodiments spaces 250 are irregularly formed to accommodate other hardware inside of housing 105.

Figure 5:
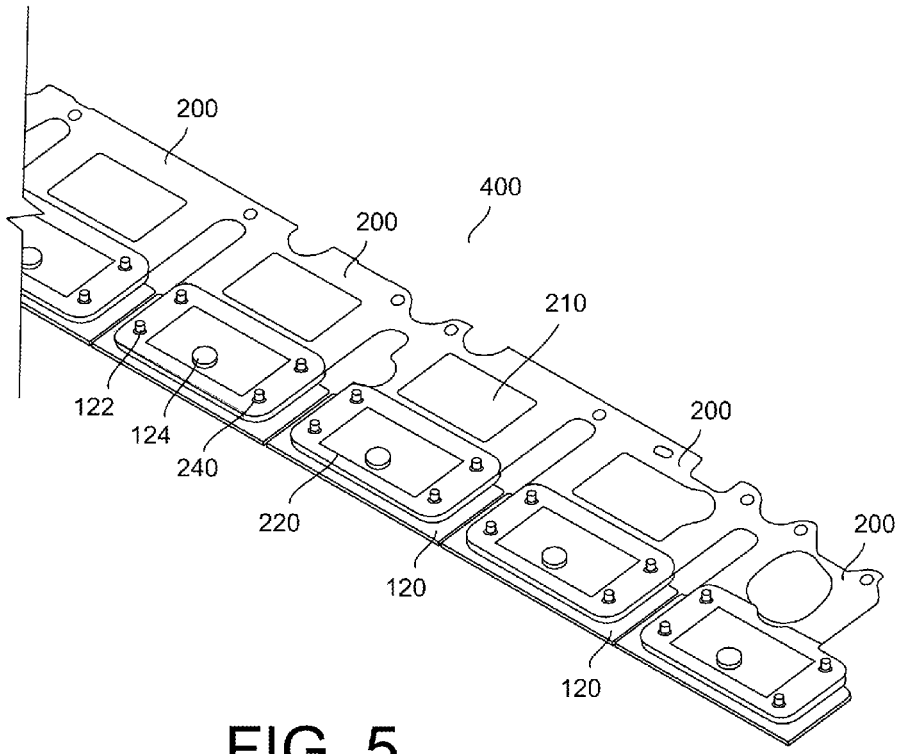
FIG. 5 is a bottom perspective view of an exemplary spring and keycap portion of the input device of FIG. 1.

FIG. 5 shows a bottom perspective view of an exemplary plurality of springs 200 unitarily formed from a sheet of material and the keycaps 120 affixed to the springs 200. In some implementations, keycap 120 is affixed to spring 200 by posts 122 that fit through openings 240. In further implementations, keycap 120 extends beyond the left and right edges of spring 200, covering gaps 250 and causing the adjacent keycaps 120 to appear to touch. In some implementations, keycap 120 may also include projection 124 on a bottom surface of keycap 120. Projection 124 may enable keycap 120 to more quickly make contact with a switch 310 disposed below the spring 200. In other implementations (not shown) projection 124 may be formed as part of spring 200' or adhered to spring 200'.

Figure 6:
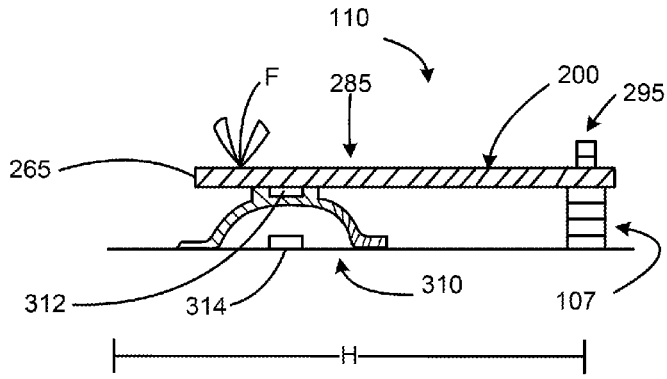
FIG. 6 is a cross-sectional view of a key of the input device of FIG. 1 taken along line A-A of FIG. 1.

FIG. 6 shows a cross-sectional view of a key 110 of input device 100 taken along line A-A of FIG. 1. As discussed above, key 110 includes spring 200 and switch 310. Spring 200 may be attached to housing 105 by structure 107. Such an attachment may allow spring 200 to have a cantilevered configuration. In such a configuration the spring 200 is suspended by the attached edge and bends or flexes from a pivot point 295.

The switch 310 is disposed below spring 200 and keycap 120 such that the keycap 120 is configured to actuate the switch 310 when the spring 200 is disposed in its second configuration. In the illustrated implementation, the switch 310 is disposed between the front edge 265 and the midpoint 285 of the height of the spring and approximately centered between the left edge and the right edge. The positioning of switch 310 may allow key 110 to feel like it is travelling straight up-and-down rather than tilting from the pivot point 295 when it is moved it its second configuration. For example, in some embodiments, the switch 310 has a collapsible structure, such as a dome, and the center of the collapsible structure may be located 18.5 mm from the openings 230 when spring 200 has a height of approximately 21.03 mm and opening 210 has a height of approximately 7.5 mm.

The switch 310 is configured to be actuated by the keycap 120 when the keycap 120 is moved in a downward direction (e.g., when the keycap 120 is depressed by a user). As previously discussed, the placement of switch 310 forward of the midpoint of the height of the spring allows switch 310 to intercept some of the rotational force of spring 200 when it is in a depressed configuration, making a user feel that key 110 is moving straight up and down rather than pivoting (or hinging) around the pivot point where spring 200 is attached to housing 105. Approximately centering the switch between the left edge and right edge increases the stability of the key 110 as a user depresses the key 110.

The switch 310 may be any type of mechanical or electrical switch that is configured to communicate with a display or other device. In the illustrated implementation, the switch 310 is an electric-dome type switch and is configured to communicate with a processor of a computer system. When the switch 310 is actuated or activated, a first metal contact 312 of the switch 310 contacts a second metal contact 314 to complete or break an electrical circuit to communicate to the processor, display, or other component of the computer system, that the switch 310 has been actuated. For example, the switch 310 may be configured to communicate with a central processing unit and a display device (monitor) of a computer system.

In some embodiments, switch 310 is a collapsible structure that causes a snappy feel with 0.15 to 0.5 mm of travel. In some embodiments, the collapsible structure is a metal dome that has a peak force and a travel that compliments the amount of force required to move spring 200 from the first configuration to the second configuration. Peak force is an amount of force needed to collapse the dome and travel is the distance needed to fully collapse the dome. For example, a metallic dome switch with 170 g of peak force and 0.18 mm of travel may compliment an opening 210 with a height of 7.5 mm when spring 200 has a height of 21.03 mm.

Figure 7:
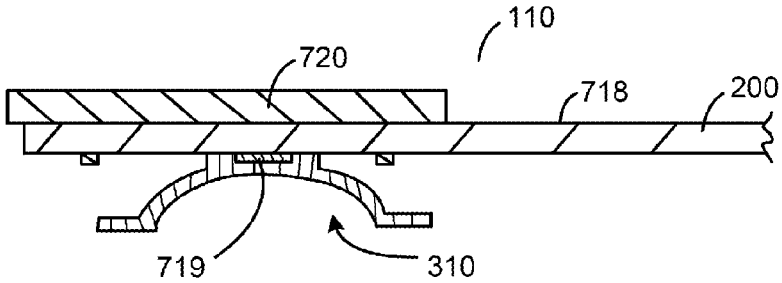
FIGS. 7-9 are cross-sectional views of portions of other example input devices.
Figure 8:
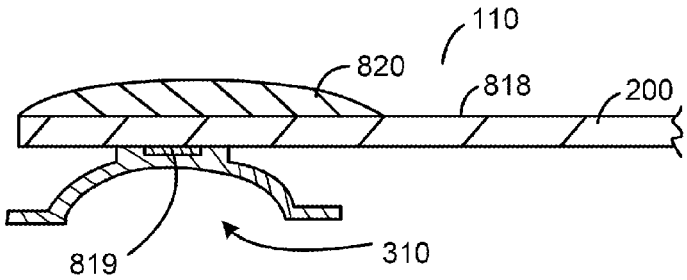
Figure 9:
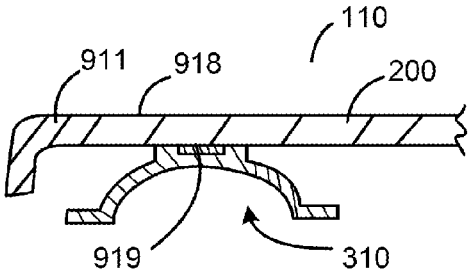

FIGS. 7-9 are cross-sectional views of various key assemblies. As illustrated in FIG. 7, the key 110 may include a material 720 disposed on an upper surface 718 of the key 110. The material 720 may provide a contour or ridge to the keycap 110 or may otherwise enhance the tactile feel of the key 110 to a user.

In some implementations, the key 110 is a key of a computer keyboard and only some of the keys of the keyboard may include the second material 720. In other implementations, all of the keys of the keyboard include the additional material. In some embodiments, a portion of a bottom surface 719 of spring 200 contacts switch 310. In such embodiments the portion of the bottom surface 719 may contact switch 310 after pressure has been applied to keycap 820.

As illustrated in FIG. 8, a key 110 is configured to actuate switch 310 when it moves from a first position to a second position. The key 110 is configured to actuate the switch 310 when the key 110 is in its second position. The key 110 includes a second material 820 disposed on an upper surface 818 of the key 110. The second material 820 includes a rounded or curved upper surface. The rounded or curved upper surface of the second material 820 provides the user a tactile feedback and may assist the user in locating the location of the keycap on the keyboard. In some implementations, the key 110 is a key of a computer keyboard and only some of the keycaps of the keyboard include the second material. In other implementations, all of the keycaps of the keyboard include the second material. In some embodiments, a portion of a bottom surface 819 of spring 200 contacts switch 310. In other embodiments (not shown), a portion of a bottom surface of keycap 820 contacts switch 310 through opening 220. In some embodiments the portion of the bottom surface of spring 200 or keycap 820 contacts switch 310 after pressure has been applied to keycap 820.

As illustrated in FIG. 9, a key 110 is configured to actuate the switch 310 when it moves from a first position to a second position. The key 110 may include an end portion 911 that is bent or curved in a direction away from an upper surface 918 of the key 110. A portion of a bottom surface 919 of spring 200 may contact spring 310 when spring 200 is moved to its second configuration.

Figure 10:
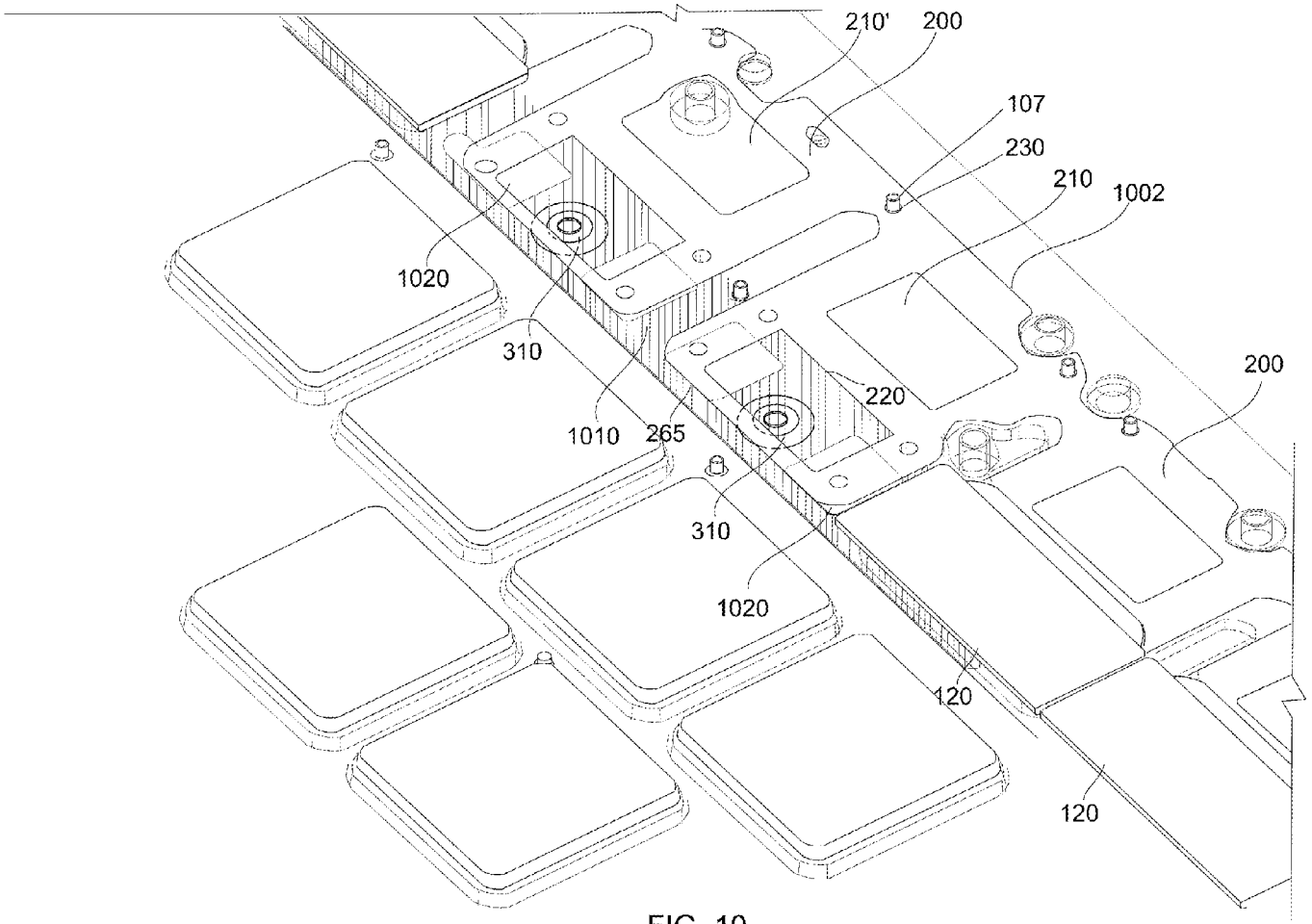
FIG. 10 is a perspective view showing the switch and spring portions that include a key of the input device of FIG. 1.

FIG. 10 is an illustration of an input device 100 with portions of the housing 105 and keycaps 120 removed. In the illustration, device 100 is a portion of a laptop computer. The input device 100 includes several springs 200 unitarily formed from a sheet of material 1002. The springs 200 define a plurality of keys 110 that are configured to actuate switches 310 disposed below the springs 200. In the illustration, the springs 200 are affixed to the housing 105 by posts 107 and suspended above the switches 310. Switches 310 are disposed between the mid-point of the height of the springs 200 and the front edge 265 of the springs 200. Springs 300 may also include openings 210. Openings 210 may be generally rectangular, but may also have an irregular shape to accommodate structures in housing 105, as illustrated by opening 210'.

In some embodiments, device 100 includes keyboard membrane 1010, represented by hashed lines in FIG. 10. Switches 310 may rest atop the membrane 1010 and/or be operably connected to it. In some embodiments, membrane 1010 may include several openings 1020. Openings 1020 may allow light from a light source, such as a light emitting diode, to pass through membrane 1010 and opening 220 to backlight keycap 120. In other embodiments the keyboard membrane 1010 may be transparent to allow light to pass through and backlight keycap 120.

In some implementations, the switches 310 are metal domes that have a low profile. This allows the keys 110 to have a smaller thickness than a traditional function key or the QWERTY keys of the keyboard. The cantilevered configuration of the springs 200 may also allow the function keys to appear seamless to the housing of the laptop. In some implementations they keycaps 120 are formed of the same material as housing 105, to enhance the seamless look.

Figure 11:
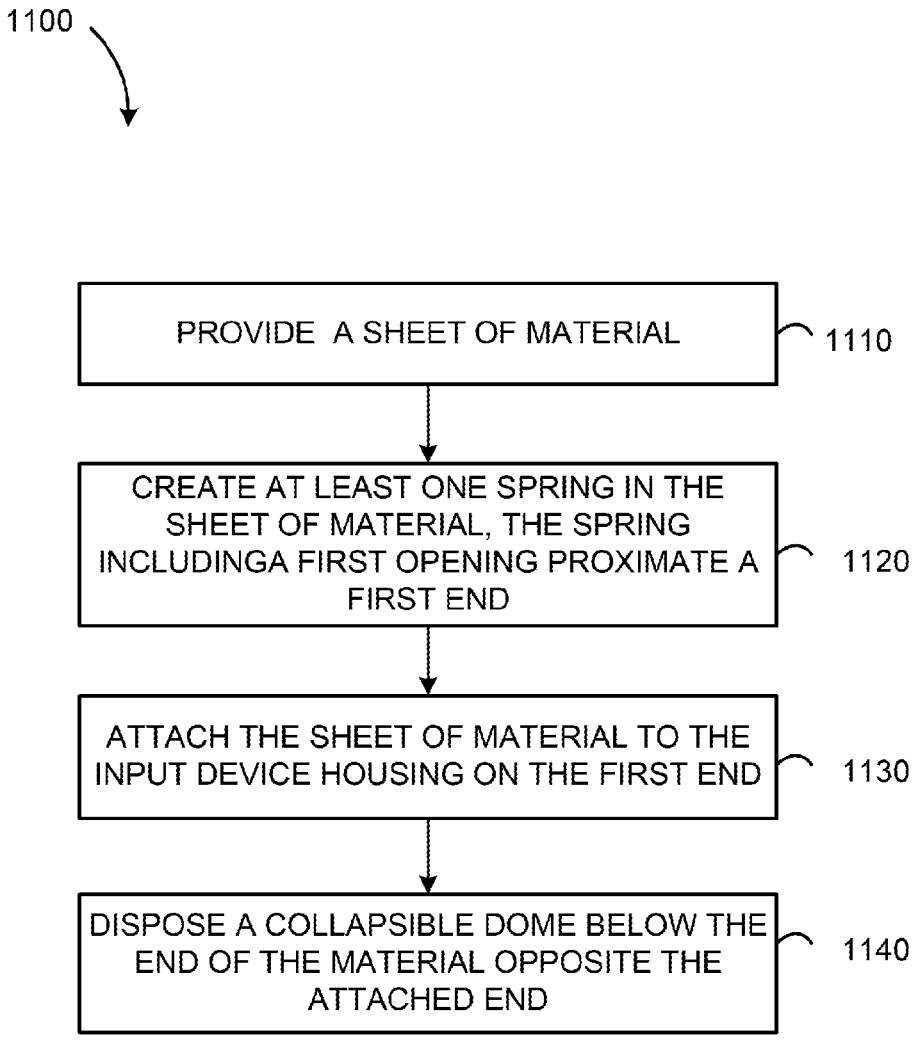
FIG. 11 is a flow chart of a method for forming an input device.

FIG. 11 is a flow chart for a method 1100 for making cantilevered integrated keys. At step 1110, a sheet of material is provided. The sheet of material may be a sheet of metal, plastic, or another type of flexible material.

At step 1120, at least one spring is created in the sheet of material. The spring defines a first key and a second spring, if created, defines a second key. The first spring may be created using any known method for shaping a sheet of material. For example, in some implementations, the sheet of material is laser-drilled or punched to create the first spring.

In other implementations, an etching process may be used to create the first spring in the sheet of material. For example, if the sheet of material is a metal material, a resist material may be placed on the sheet of material such that the entire sheet of material is covered with the resist material. The resist material may then be removed from the sheet of material at selected locations (for example, where the first opening will be or the first gap between springs). The sheet of material may then be exposed to an acid that is configured to eat or dissolve the metal material. Accordingly, an opening will be formed in the sheet of material that does not include or is not coated with the resist material.

Creating the at least one spring may involve creating a first opening in the spring, the first opening being proximate a first end of the spring that is configured for attachment to a housing of the input device. The first opening may be created using any of the methods described above for creating the at least one spring. Creating the at least one spring may also involve creating a second opening in the spring, the second opening being disposed between a mid-point of the height of the spring and a second end opposite the first end.

At step 1130, the one or more springs are attached at the first end to the housing of the input device. The springs are attached to the housing in a cantilevered manner, so that only one end of spring 200 is attached. In some implementations the springs are attached to the housing a post.

At step 1140, a collapsible structure, such as a metal dome, is disposed below a second end of the spring, the second end being opposite of the first end. The collapsible structure forms a switch that may be actuated when a user applies force to a top surface of the key. In some embodiments, a second material is placed on a top surface of the one or more springs.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. An input device for a computing device comprising:
- a collapsible structure used to complete a circuit; and
- a sheet of material disposed above the collapsible structure, the sheet comprising:
  - an attached edge affixed to the input device, creating a pivot point,
  - a front edge opposite the attached edge,
  - a left edge,
  - a right edge opposite the left edge,
  - a first opening formed proximate the attached edge, wherein the first opening is concealed from a user by a housing of the input device during operation of the input device, and
  - a top surface proximate the front edge that is visible to the user during operation of the input device,
- wherein the collapsible structure is disposed below a portion of the sheet of material located between the front edge and the first opening.

2. The input device of claim 1, wherein the sheet further comprises:
- a width extending from the left edge to the right edge; and
- a height extending from the front edge to the pivot point,
- wherein the first opening is located between the left edge and the right edge, and the collapsible structure is disposed between the front edge and a midpoint of the height of the sheet and approximately centered between the left edge and the right edge.

3. The input device of claim 1, wherein the collapsible structure is a dome switch.

4. The input device of claim 1, wherein the sheet of material is suspended in a cantilevered manner above the collapsible structure.

5. The input device of claim 1, wherein the collapsible structure is located at a position that is more towards the front edge of the sheet than the first opening.

6. The input device of claim 1, wherein the sheet of material is configured to bend when the user applies pressure to the top surface of the sheet.

7. The input device of claim 1, further comprising a keycap disposed above the top surface of the sheet proximate the front edge.

8. The input device of claim 7, further comprising a second opening cut proximate the front edge of the sheet, the second opening being at least as large as the first opening.

9. The input device of claim 8, the input device further comprises a light source, wherein the keycap is disposed above the second opening and comprises material that enables an indicium included on the keycap to glow when the light source is lit.

10. The input device of claim 1, wherein the input device is configured to communicate with a central processing unit of the computing device.

11. The input device of claim 1, wherein the input device comprises a plurality of collapsible structures and sheets of material, wherein the sheets of material are unitarily formed from a single sheet of material so that the plurality of sheets are joined at the attached edges and each sheet is defined by spaces formed between the respective right and left edges.

12. An input device comprising a plurality of keys, each key comprising:

a switch; and a spring disposed above the switch, the spring comprising:

a back edge affixed to the input device, a front edge opposite the back edge, and a first opening formed proximate the back edge, the first opening being concealed from a user by a housing of the input device during operation of the input device, wherein each spring has an associated switch and a portion of a bottom surface of the spring is configured to contact the switch, the portion of the bottom surface being at a location between the front edge of the spring and the first opening, and wherein the plurality of springs are unitarily formed from a sheet of material so that the springs are joined at the back edge and separated from adjoining springs by a gap formed in the material.

13. The input device of claim 12, wherein the back edge creates a pivot point and the spring further comprises:

a left edge;

a right edge opposite the left edge; and a height extending from the front edge to the pivot point, wherein the first opening is between the left edge and the right edge, and wherein the portion of the bottom surface is located between the front edge of the spring and a midpoint of the height of the spring and approximately centered between the left edge and the right edge.

14. The input device of claim 13, wherein the switch is a collapsible dome switch and each spring is configured to move from a first configuration to a second configuration when the user applies pressure to a top surface of the spring and wherein the pressure causes the portion of the bottom surface to contact and collapse the collapsible switch, completing a circuit.

15. The input device of claim 14, wherein the center of each switch is located at a position that is more towards the front edge of the spring than the first opening.

16. The input device of claim 15, wherein the size of the first opening affects the amount of pressure needed to move the spring from the first configuration to the second configuration.

17. The input device of claim 12, wherein each spring has a top surface proximate the front edge that is visible to the user during operation of the input device.

18. The input device of claim 17, each key further comprising a keycap affixed atop the top surface of the spring.

19. The input device of claim 18, each spring further comprising a second opening cut proximate the front edge, the second opening allowing a light source to backlight the affixed keycap and the second opening being at least as large as the first opening.

20. An input device comprising a plurality of keys, each key comprising:

a collapsible dome;

a keycap; and a spring attached to a housing of the input device on a first end and having a second end opposite the first end, a first opening located proximate the first end, and a second opening located proximate the second end, the spring being configured to bend around the first end at a pivot point when a user applies pressure to a top surface of the keycap, wherein the keycap is disposed above the second opening, wherein a portion of a bottom surface of the keycap contacts the collapsible dome when pressure is applied to the keycap, the pressure causing the dome to collapse, sending an input to a processor of a computing device, and wherein the plurality of springs are unitarily formed from a sheet of material, each spring being separated from adjoining springs by a gap formed in the material so that the plurality of springs are joined at the first end.

21. The input device of claim 20, wherein the sheet of material is a metal.

22. The input device of claim 21, wherein the second opening allows a light source to backlight the keycap.

23. The input device of claim 20, wherein the plurality of keys are function keys.

24. The input device of claim 20, wherein the portion of the bottom surface of the keycap that contacts the collapsible dome is located between the second end of the spring and a midpoint of a height of the spring and approximately centered between a left edge and a right edge of the spring.

25. The input device of claim 20, wherein the size of the first opening affects an amount of the pressure needed to cause the dome to collapse.

* * * * *